US007089890B2

(12) United States Patent
Obidi

(10) Patent No.: US 7,089,890 B2
(45) Date of Patent: Aug. 15, 2006

(54) COOLING SYSTEM FOR AN INTERNAL COMBUSTION ENGINE WITH EXHAUST GAS RECIRCULATION (EGR)

(75) Inventor: T. Yomi Obidi, Melrose Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/889,400

(22) Filed: Jul. 12, 2004

(65) Prior Publication Data

US 2006/0005791 A1 Jan. 12, 2006

(51) Int. Cl.
*F01P 3/18* (2006.01)

(52) U.S. Cl. ..... 123/41.31; 123/568.12

(58) Field of Classification Search ..... 123/568.12, 123/568.11, 41.31, 41.72, 41.67
See application file for complete search history.

(56) References Cited

U.S. PATENT DOCUMENTS 5,419,287 A * 5/1995 Evans ..... 123/41.29
5,970,927 A * 10/1999 Suzuki ..... 123/41.29
6,367,256 B1 * 4/2002 McKee ..... 60/605.2
6,715,473 B1 * 4/2004 Ritchie et al. ..... 123/568.12
6,739,290 B1 * 5/2004 Iwasaki et al. ..... 123/41.05
6,826,903 B1 * 12/2004 Yahata et al. ..... 60/278

* cited by examiner

*Primary Examiner*—Stephen K. Cronin
*Assistant Examiner*—Jason Benton
(74) *Attorney, Agent, or Firm*—Dennis K. Sullivan; Susan L. Lukasik; Jeffrey P. Calfa

(57) ABSTRACT

A cooling system pumps coolant through parallel connections to a crankcase and an EGR cooler in an internal combustion engine with exhaust gas recirculation (EGR). A crankcase supply conduit connects a coolant pump to a coolant channel formed by the crankcase. The coolant channel is connected to a coolant chamber formed by the cylinder head. An EGR cooler supply conduit connects the EGR cooler to the coolant pump. The EGR cooler is connected to the coolant chamber. Coolant flows from the coolant pump into the crankcase supply conduit and into the EGR cooler supply conduit at essentially the same time and at essentially the same temperature. The coolant circulates from the coolant pump through the coolant channel into the coolant chamber. The coolant circulates from the coolant pump through the EGR cooler into the coolant chamber. The coolant returns to the coolant pump from the coolant chamber in the cylinder head.

17 Claims, 2 Drawing Sheets

COOLING SYSTEM FOR AN INTERNAL COMBUSTION ENGINE WITH EXHAUST GAS RECIRCULATION (EGR)

FIELD OF THE INVENTION

This invention generally relates to cooling systems in internal combustion engines with exhaust gas recirculation (EGR). More particularly, this invention relates to cooling systems that reduce the temperature of exhaust gases prior to mixing the exhaust gases with intake air in an internal combustion engine.

BACKGROUND OF THE INVENTION

Internal combustions engines convert chemical energy from a fuel into mechanical energy. The fuel may be petroleum-based (gasoline or diesel), natural gas, a combination thereof, or the like. Some internal combustion engines, such as gasoline engines, inject an air-fuel mixture into one or more cylinders for ignition by a spark from a spark plug or the like. Other internal combustion engines, such as diesel engines, compress air in the cylinder and then inject fuel into the cylinder for the compressed air to ignite. An internal combustion engine may use a camshaft system, a hydraulically activated electronically controlled unit injection (HEUI) system, or the like to control the fuel injection into the cylinders. In each cylinder, the ignited fuel generates rapidly expanding gases that actuate a piston in the cylinder. The piston usually is connected to a crankshaft or similar device for converting the reciprocating motion of the piston into rotational motion. The rotational motion from the crankshaft may be used to propel a vehicle, operate a pump or an electrical generator, or perform other work. The vehicle may be a truck, an automobile, a boat, or the like.

Most internal combustion engines have a cooling system to circulate coolant through the engine. The coolant removes heat from the engine during operation. The coolant may be water, an antifreeze fluid such as ethylene glycol, a combination thereof, or the like. The cooling system usually is connected to a radiator or other heat exchanger that removes heat from the coolant. The cooling system typically has a water or coolant pump that moves coolant through the engine crankcase, around each cylinder, and into the cylinder head. The coolant may flow from the crankcase, through other components in the engine such as an oil cooler, and into the cylinder head. The coolant flows from the cylinder head, through the radiator, and returns to the coolant pump for continued circulation through the engine. The cooling system may have a thermostat to prevent coolant flow through the radiator when the engine is cold such as during engine startup.

Many internal combustion engines use an exhaust gas recirculation (EGR) system to reduce the production of nitrogen oxides ($NO_x$) during the combustion process in the cylinders. EGR systems typically divert a portion of the exhaust gases exiting the cylinders for mixing with intake air. The exhaust gas generally lowers the combustion temperature of the fuel below the temperature where nitrogen combines with oxygen to form nitrogen oxides ($NO_x$).

Many EGR systems have an EGR cooler or heat exchanger that reduces the temperature of the exhaust gases. Generally, more exhaust gas can be mixed with the intake air when the exhaust gas temperature is lower. Additional exhaust gases in the intake air may further reduce the amount of $NO_x$ produced by the engine.

Most EGR coolers have a counter flow arrangement to remove heat from the exhaust gases. In the EGR cooler, the exhaust gases pass in one direction along one side of a wall or other barrier. A cooling medium passes in the opposite direction on the opposite side of the wall. The cooling medium may be air, water, or another fluid. When the cooling medium has a lower temperature than the exhaust gases, heat transfers from the exhaust gases through the wall into the cooling medium. The heat transfer lowers the temperature of the exhaust gases. The heat transfer can be increased by increasing the temperature difference between the exhaust gases and the cooling medium. Conversely, the heat transfer can be decreased by decreasing the temperature difference. The heat transfer can be increased by increasing the surface area or length of the wall separating the exhaust gases and the cooling medium. Conversely, the heat transfer can be decreased by decreasing the surface are or length of the wall.

Many EGR coolers use coolant from the engine's cooling system to reduce the temperature of the exhaust gases. Typically, the EGR cooler is connected to another engine component in series so that the same coolant flows through the other component and then the EGR cooler in sequence. In some internal combustion engines, the coolant flows sequentially from the coolant pump through the crankcase, through an oil cooler prior, and then through the EGR cooler. The coolant usually flows from the EGR cooler into the cylinder head, where it combines with coolant from the crankcase for return to the coolant pump.

The sequential flow of coolant through engine components may increase the coolant temperature before the coolant flows through the EGR cooler. In some internal combustion engines, the temperature of coolant into the EGR cooler may be about 3 to 5 degrees higher than the temperature of coolant exiting the coolant pump. The coolant temperature may increase about 1 to 2 degrees as the coolant flows from the coolant pump through the crankcase to the oil cooler. The coolant temperature may increase about 2 to 3 degrees as the coolant flows through the oil cooler to the EGR cooler. These and other internal combustion engines may have different temperature increases as coolant flows through engine components to the EGR cooler.

The higher coolant temperature reduces the heat transfer of the EGR cooler. The lower heat transfer decreases the temperature reduction of the exhaust gases through the EGR cooler. A larger EGR cooler may be needed to provide sufficient heat transfer for a desired exhaust gas temperature. A larger EGR cooler may increase the costs of the EGR and cooling systems. Some engines may not be able to use a larger EGR cooler due to space limitations. These engines may have less exhaust gas recirculation, which may result in lower $NO_x$ reduction.

SUMMARY

This invention provides a cooling system for an internal combustion engine with exhaust gas recirculation (EGR). The cooling system pumps coolant through parallel connections to a crankcase and an EGR cooler. The coolant flows from a coolant pump to the crankcase and the EGR cooler at essentially the same time and at essentially the same temperature.

The cooling system may have a coolant pump with parallel connections to a crankcase and an EGR cooler. The coolant circulates from the coolant pump through the crankcase to a cylinder head. The coolant circulates from the coolant pump through the EGR cooler to the cylinder head. The coolant returns to the coolant pump from the cylinder head.

The cooling system may have a coolant pump, a front cover, a crankcase, a cylinder head, and an EGR cooler. The coolant pump is mounted on the front cover. The front cover forms a crankcase supply conduit connected to an outlet side of the coolant pump. The front cover forms a coolant inlet connected to the inlet side of the coolant pump. The crankcase is connected to the front cover. The crankcase forms a coolant channel, a crankcase inlet, and one or more crankcase outlets. The crankcase inlet and the crankcase outlets are connected to the coolant channel. The crankcase inlet connects to the crankcase supply conduit. The cylinder head is connected to the crankcase. The cylinder head forms a coolant chamber connected to the crankcase outlets. The EGR cooler is connected between an EGR cooler supply conduit and an EGR cooler outlet conduit. The EGR cooler supply conduit connects to the inlet side of the coolant pump. The EGR cooler outlet conduit connects to the coolant chamber. Coolant flows from the coolant pump to the crankcase supply conduit and to the EGR cooler supply conduit at essentially the same time and at essentially the same temperature.

In a method of cooling an internal combustion engine with exhaust gas recirculation (EGR), coolant is pumped through parallel connections to a crankcase and an EGR cooler. The coolant circulates through the EGR cooler. The coolant circulates through the crankcase.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
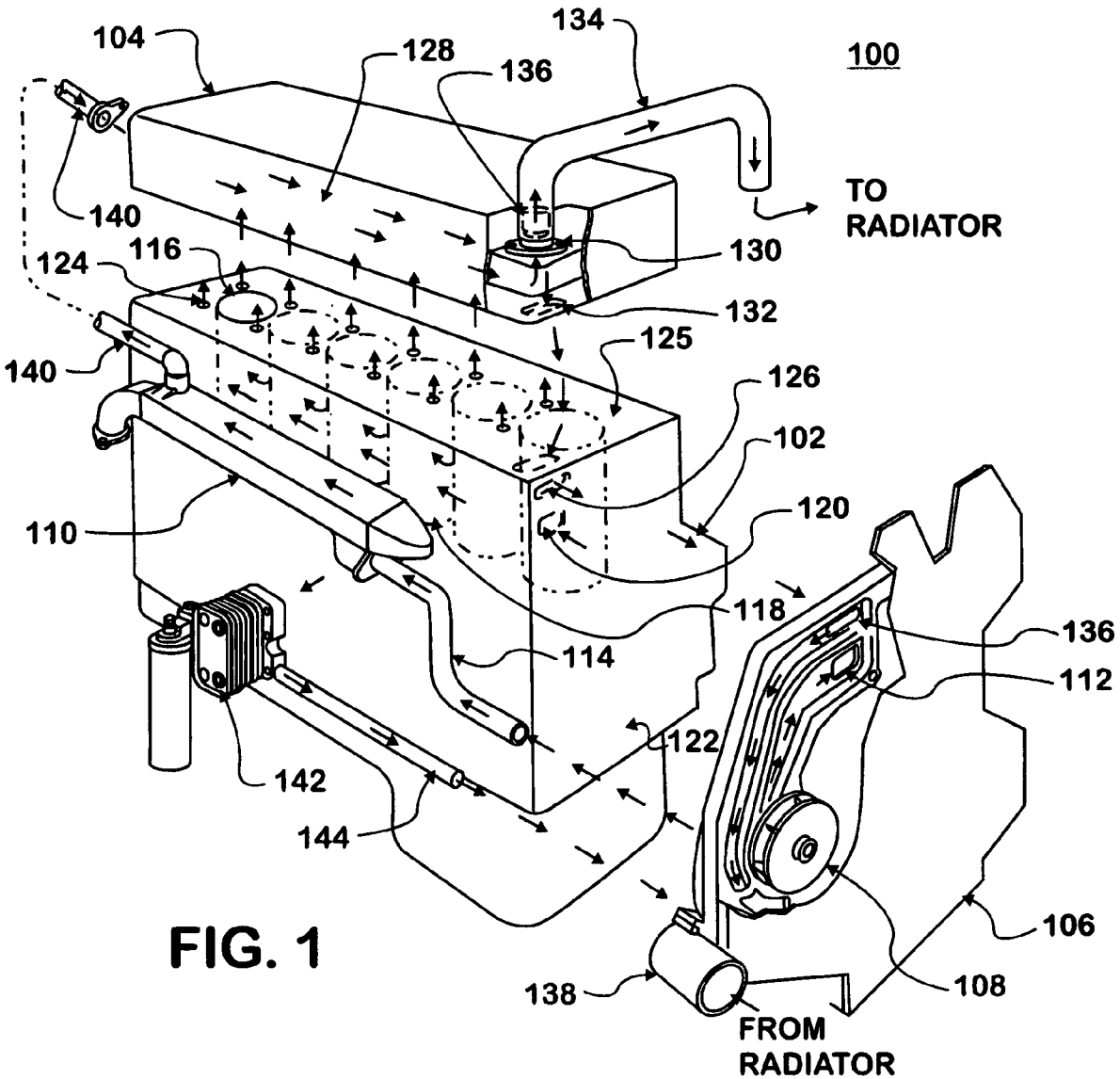
FIG. 1 is an expanded, perspective view of a cooling system in an internal combustion engine with exhaust gas recirculation (EGR).

FIG. 1 is an expanded, perspective view of a cooling system 100 in an internal combustion engine with exhaust gas recirculation (EGR). The internal combustion engine has a crankcase 102, a cylinder head 104, and a front cover 106. The internal combustion engine may have other components and configurations. The cooling system 100 circulates coolant through the engine to remove heat from the engine. The coolant may be water, an antifreeze compound like ethylene glycol, a combination thereof, or the like. The cooling system 100 has a coolant pump 108 in the front cover 106. The coolant pump 108 has parallel connections to the crankcase 102 and an EGR cooler 110. Parallel connections include separate and non-sequential conduits where coolant flows at essentially the same time and at essentially the same temperature. The coolant pump 108 pumps coolant to the crankcase 102 through a crankcase supply conduit 112 formed by the front cover 106. The coolant pump 108 pumps coolant to the EGR cooler 110 through an EGR supply conduit 114. Coolant flows or circulates through the crankcase 102 into the cylinder head 104. Coolant flows or circulates through the EGR cooler 110 into the cylinder head 104. The coolant returns to the coolant pump 108 from the cylinder head 104 through a radiator, a radiator by-pass, or both for continued circulation through the engine. While a particular configuration is shown, the cooling system 100 may have other configurations including those with other components.

The crankcase 102 forms one or more cylinders 116, each with a piston (not shown) that reciprocates during engine operation. The cylinders 116 may be arranged in one bank such as an in-line arrangement. The cylinders 116 may be arranged in two banks at an angle such as a V arrangement. The cylinders 116 may be arranged in two banks on opposite sides such as a flat or horizontal arrangement. The cylinders 116 may have other arrangements. The crankcase 102 forms a coolant channel 118 that substantially encloses or surrounds the sides of each cylinder 116. The crankcase 102 forms a crankcase inlet 120 on a front side 122 adjacent to the front cover 106. The crankcase inlet 120 connects to the coolant channel 118. The crankcase 102 forms one or more crankcase outlets 124 on a top side 125 adjacent to the cylinder head 104. The crankcase outlets 124 may be positioned essentially equidistant around the cylinders 116 or in another arrangement near the cylinders 116. The crankcase outlets 124 connect to the coolant channel 118. The crankcase 102 forms a by-pass conduit 126 that extends from the top side 125 to the front side 122.

The cylinder head 104 forms a coolant chamber 128 that extends along the top of the cylinders 116 when the cylinder head 104 is connected to the crankcase 102. The crankcase outlets 124 connect to the coolant chamber 128 when the cylinder head 104 is connected to the crankcase 102. The cylinder head 104 forms a coolant outlet 130 and a by-pass inlet 132. A radiator inlet conduit 134 may be connected on one end to the coolant outlet 130. The radiator inlet conduit 134 may be connected on the other end to a radiator (not shown).

A thermostat or other control valve 136 may be operatively disposed between the coolant outlet 130 and the by-pass inlet 132. Operatively disposed includes positions where the thermostat 136 can open and close the coolant outlet 130 and the by-pass inlet 132. When the coolant temperature is below a threshold temperature, the thermostat 136 closes the coolant outlet 130 and opens the by-pass inlet 132. When the coolant temperature is above the threshold temperature, the thermostat 136 opens the coolant outlet 130 and closes the by-pass inlet 132. When the coolant temperature is at or near the threshold temperature, the thermostat 136 may have a transition where the coolant outlet 130 is partially opened and the by-pass inlet 132 is partially closed. The threshold temperature may be about 180° F. (82° C.). Other threshold temperatures may be used. The thermostat 136 may operate in response to other parameters.

The coolant pump 108 is mounted on the front cover 106. The coolant pump 108 may be a mechanical pump connected to operate from the rotation of the engine crankshaft (not shown). The coolant pump 108 maybe an electrical or other type of pump.

The front cover 106 forms the crankcase supply conduit 112, which connects to the outlet side of the coolant pump 108. The crankcase supply conduit 112 connects to the crankcase inlet 120 when the front cover 106 is connected to the crankcase 102. The front cover 106 forms a by-pass passage 136 that is connected to the inlet side of the coolant pump 108. The by-pass passage 136 connects to the by-pass conduit 126 when the front cover is connected to the crankcase 102. The front cover 106 forms a coolant inlet 138 that is connected to the inlet side of the coolant pump 108. The coolant inlet 138 may be connected to the radiator. The crankcase supply conduit 112, the by-pass passage 136, and the coolant inlet 138 may be pipes, tubes, or other fluid carrying devices.

The EGR cooler 110 is part of an EGR system (not shown). The EGR system diverts a portion of the exhaust gases from an exhaust manifold (not shown) to an intake air manifold (not shown) on the internal combustion engine. The exhaust gases pass through the EGR cooler 110 prior to entering the intake air manifold. The EGR supply conduit 114 connects the EGR cooler 110 to the outlet side of the coolant pump 108. An EGR outlet conduit 140 connects the EGR cooler 110 to the coolant chamber 128 formed by the cylinder head 104.

The internal combustion engine may have an oil cooler 142 connected to the coolant channel 118 in the crankcase 102. The oil cooler 142 may be a heat exchanger or another heat transfer device that removes heat from the hydraulic system (not shown). An oil cooler conduit 144 connects the oil cooler 142 to the inlet side of the coolant pump 108.

The crankcase 102, cylinder head 104, and front cover 106 may be made of iron, steel, other metals, a ceramic, a combination thereof, and like materials. The EGR conduits 114 and 140, the radiator inlet conduit 134, and the oil cooler conduit 144 may be tubes, pipes, or the like, and may be made of metal, an elastomeric material, a combination thereof, or like materials.

During engine operation, the coolant pump 108 circulates coolant through the cooling system 100. The coolant flow is represented by the arrows in FIG. 1. Other coolant flows may be used.

The coolant pump 108 receives coolant from the coolant chamber 128 formed by the cylinder head 104. The coolant flows from the coolant chamber 128 through the radiator and/or the radiator by-pass to the coolant pump 108. The thermostat 136 directs the coolant flow from the coolant chamber 128 through the coolant outlet 130 to the radiator and/or through the by-pass inlet 132 to the radiator by-pass. When the coolant temperature is below the threshold temperature, the thermostat 136 directs the coolant through the radiator by-pass. When the coolant temperature is above the threshold temperature, the thermostat 136 directs the coolant through the radiator. When the coolant temperature is at or near the threshold temperature, the thermostat 136 may direct the coolant through both the radiator and the radiator by-pass.

The coolant may flow from the coolant chamber 128 through the by-pass inlet 132 into the radiator by-pass—the by-pass conduit 126 and the by-pass passage 136. Other radiator by-passes may be used including those external to the crankcase. The coolant flows through the by-pass conduit 126, through the by-pass passage 136, and into the inlet side of the coolant pump 108. The by-pass coolant temperature via the by-pass inlet 132 may be up to about the threshold temperature of the thermostat 136.

The coolant may flow from the coolant chamber 128 through the coolant outlet 130 and radiator inlet tube 134 to the radiator. The outlet coolant temperature via the coolant outlet 130 may be up to about 235° F. (113° C.). Other outlet coolant temperatures may be used. From the radiator, the coolant flows through the coolant inlet 138 to the inlet side of the coolant pump 108. The inlet coolant temperature via the radiator may be about 212° F. (100° C.). Other inlet coolant temperatures may be used.

The coolant pump 108 provides coolant to the parallel connections for the crankcase 102 and the EGR cooler 110—the crankcase supply conduit 112 and the EGR cooler supply conduit 114, respectively. The coolant pump 108 provides coolant at essentially the same base coolant temperature and at essentially the same time to each of the parallel connections. The base coolant temperature from the coolant pump 108 may be up to about 213° F. (101° C.). Other base coolant temperatures may be used. The coolant flows from the coolant pump 108 through the crankcase supply conduit 112 and crankcase inlet 120 into the coolant channel 118 formed by the crankcase 102. From the coolant channel 118, coolant flows through the crankcase outlets 124 into the coolant chamber 128 formed by the cylinder head 104. The coolant flows from the coolant pump 108 through the EGR cooler supply conduit 114 to the EGR cooler 110. From the EGR cooler 110, the coolant flows through the EGR cooler outlet 140 to the coolant chamber 128.

Coolant flows from the coolant channel 118 through the oil cooler 142 and oil cooler conduit 144 to the inlet side of the coolant pump 108. The oil cooler 142 may increase the temperature of the coolant by about 2 degrees. The oil cooler 142 may have an input coolant temperature of about 214° F. (101° C.) and an output coolant temperature of about 218° F. (103° C.). The oil cooler 142 may have other input and output temperatures. The output coolant from the oil cooler 142 mixes with the inlet coolant from the coolant inlet 138 prior to passing through the coolant pump 108. The ratio of the output coolant to the input coolant may be about 1:10. The output coolant may increase the inlet coolant temperature up to about 1 degree. Other ratios and temperature increases may be used.

Figure 2:
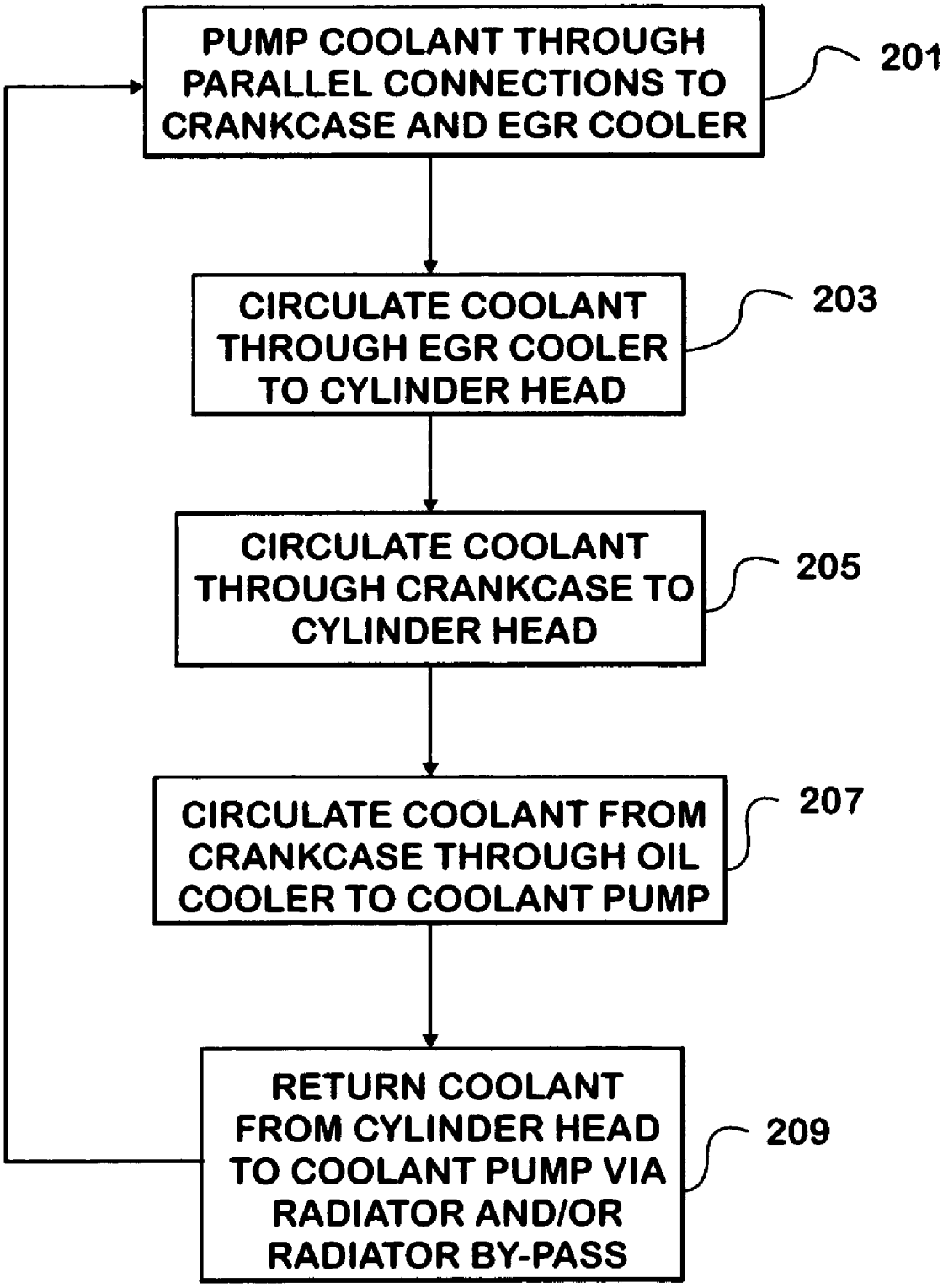
FIG. 2 is a flowchart of a method of cooling an internal combustion engine with exhaust gas recirculation (EGR).

FIG. 2 is a flowchart of a method of cooling an internal combustion engine with exhaust gas recirculation (EGR). Coolant is circulated through a crankcase, an EGR cooler, and other engine components as previously discussed. The coolant removes heat from the engine. In block 201, coolant flows from a coolant pump through parallel connections to the crankcase and the EGR cooler. Parallel connections include separate and non-sequential paths where coolant flows at essentially the same time and at essentially the same temperature. In block 203, coolant circulates through the EGR cooler to the cylinder head. In block 205, coolant circulates through the crankcase to the cylinder head. In block 207, coolant circulates from the crankcase through another engine component to the coolant pump. The engine component may be an oil cooler or other heat exchange device. In block 209, coolant returns from the cylinder head to the coolant pump. The coolant may return to the coolant pump through a radiator by-pass when the coolant temperature is below a threshold temperature. The coolant may return to the coolant pump through a radiator when the coolant temperature is above a threshold temperature. The coolant may return to the coolant pump through the radiator, the radiator by-pass, or both when the coolant temperature is about the threshold temperature. The coolant continues circulation through the engine.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. A cooling system for an internal combustion engine with exhaust gas recirculation (EGR), comprising:

a coolant pump having an outlet in direct fluid communication with a crankcase and an EGR cooler;

where the crankcase and the EGR cooler are connected in parallel, where coolant circulates from the coolant pump through the crankcase to a cylinder head, where coolant circulates from the coolant pump through the EGR cooler to the cylinder head, and where coolant returns to the coolant pump from the cylinder head.

2. The cooling system of claim 1, further comprising:

a coolant supply conduit connected between a coolant chamber formed by the crankcase and the outlet of the coolant pump;

an EGR coolant supply conduit connected between the EGR cooler and the outlet of the coolant pump;

where coolant flows from the coolant pump through the coolant supply conduit and the EGR coolant supply conduit at essentially the same time and at essentially the same temperature.

3. The cooling system of claim 1, where the crankcase forms a coolant channel;

where the cylinder head forms a coolant chamber; and where the coolant chamber connects to the coolant channel and to the EGR cooler.

4. The cooling system of claim 1, where the cylinder head forms a coolant outlet and a by-pass inlet, and where coolant returns to the coolant pump through at least one of the coolant outlet and the by-pass inlet.

5. The cooling system of claim 4, where the coolant outlet connects to a radiator inlet tube;

where the by-pass inlet connects to a by-pass conduit formed by the crankcase;

where the by-pass conduit connects to a by-pass passage formed by a front cover; and where the by-pass passage connects to the coolant pump.

6. The cooling system of claim 1, further comprising an other engine component connected to the crankcase and to the coolant pump, where coolant flows from the crankcase to the coolant pump through the other engine component.

7. A cooling system for an internal combustion engine with exhaust gas recirculation (EGR), comprising:

a coolant pump mounted on a front cover, where the front cover forms a crankcase supply conduit connected to an outlet side of the coolant pump, where the front cover forms a coolant inlet connected to the inlet side of the coolant pump;

a crankcase connected to the front cover, where the crankcase forms a coolant channel, where the crankcase forms a crankcase inlet, where the crankcase forms at least one crankcase outlet, where the crankcase inlet and at least one crankcase outlet are connected to the coolant channel, where the crankcase inlet connects to the crankcase supply conduit;

a cylinder head connected to the crankcase, where the cylinder head forms a coolant chamber connected to the at least one crankcase outlet; and an EGR cooler connected to an EGR cooler supply conduit and an EGR cooler outlet conduit, where the EGR cooler supply conduit connects to the inlet side of the coolant pump, where the EGR cooler outlet conduit connects to the coolant chamber; and where coolant flows from the coolant pump to the crankcase supply conduit and to the EGR cooler supply conduit at essentially the same time and at essentially the same temperature.

8. The cooling system of claim 7, where the cylinder head forms a coolant outlet and a by-pass inlet; and where coolant returns to the coolant pump through at least one of the coolant outlet and the by-pass inlet.

9. The cooling system of claim 8, where the front cover forms a by-pass passage connected to an inlet side of the coolant pump; and where the crankcase forms a by-pass conduit, where the by pass-conduit connects the by-pass inlet to the by-pass passage.

10. The cooling system of claim 8, further comprising a thermostat operatively disposed between the coolant outlet and the by-pass inlet.

11. The cooling system of claim 8, further comprising an oil cooler connected to the coolant channel and to the inlet side of the coolant pump, where coolant flows from the coolant channel through the oil cooler to the coolant pump.

12. A method of cooling an internal combustion engine with exhaust gas recirculation (EGR), comprising the steps of:

pumping coolant through parallel connections to a crankcase and an EGR cooler;

circulating coolant through the EGR cooler to a cylinder head;

circulating coolant through the crankcase to the cylinder head; and circulating coolant from the cylinder head back to a coolant pump.

13. The method of cooling an internal combustion engine of claim 12, wherein coolant circulates from a coolant pump to the crankcase and to the EGR cooler at essentially the same time and at essentially the same temperature.

14. The method of cooling an Internal combustion engine of claim 13, further comprising the step of returning coolant from the cylinder head to the coolant pump.

15. The method of cooling an internal combustion engine of claim 14, further comprising the step of returning coolant through at least one of a radiator and a by-pass conduit.

16. The method of cooling an internal combustion engine of claim 12, further comprising the step of circulating coolant from the crankcase through another engine component.

17. The method of cooling an internal combustion engine of claim 16, further comprising the step of circulating coolant from the crankcase through an oil cooler to the coolant pump.

* * * * *